US011233360B2

(12) United States Patent
Mandel et al.

(10) Patent No.: US 11,233,360 B2
(45) Date of Patent: Jan. 25, 2022

(54) CONNECTOR FOR HIGH-FREQUENCY TRANSMISSIONS IN THE AUTOMOTIVE FIELD, IMPEDANCE IMPROVING ELEMENT, CONNECTION ASSEMBLY, METHOD OF IMPROVING THE IMPEDANCE IN A CONNECTOR

(71) Applicant: TE Connectivity Germany GmbH, Bensheim (DE)

(72) Inventors: Christian Mandel, Darmstadt (DE); Bert Bergner, Rimbach (DE); Samir Aboulkassem, Griesheim (DE); Mohammad Nikfal, Darmstadt (DE); Ralf Schmidt, Fuerth (DE); Hyo Chang (Chris) Yun, San Jose, CA (US)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/849,627

(22) Filed: Apr. 15, 2020

(65) Prior Publication Data

US 2020/0328562 A1 Oct. 15, 2020

(30) Foreign Application Priority Data

Apr. 15, 2019 (EP) ..... 19169265

(51) Int. Cl.

| | |
|---|---|
| ***H01R 13/648*** | (2006.01) |
| ***H01R 13/6477*** | (2011.01) |
| *H01R 24/28* | (2011.01) |
| *H01R 101/00* | (2006.01) |

(52) U.S. Cl.

CPC ..... *H01R 13/6477* (2013.01); *H01R 24/28* (2013.01); *H01R 2101/00* (2013.01); *H01R 2201/26* (2013.01)

(58) Field of Classification Search

CPC ..... H01R 13/6477; H01R 24/28; H01R 2101/00; H01R 2201/26

USPC ..... 439/578–585, 607.01

See application file for complete search history.

(56) References Cited

U.S. PATENT DOCUMENTS

| | | | |
|---|---|---|---|
| 2,904,619 | A | 9/1959 | Forney, Jr. |
| 3,283,287 | A | 11/1966 | Stark et al. |
| 3,373,243 | A | 3/1968 | Janowiak et al. |
| 3,384,703 | A | 5/1968 | Forney, Jr. et al. |
| 3,439,294 | A | 4/1969 | Flanagan et al. |
| 3,499,101 | A | 3/1970 | Forney, Jr. |

(Continued)

FOREIGN PATENT DOCUMENTS

| | | | |
|---|---|---|---|
| DE | 102012201565 | A1 | 8/2012 |
| EP | 0339067 | B1 | 7/1996 |

(Continued)

OTHER PUBLICATIONS

Extended European Search Report, dated Sep. 10, 2020, 8 pages.

(Continued)

*Primary Examiner* — Khiem M Nguyen
(74) *Attorney, Agent, or Firm* — Barley Snyder

(57) ABSTRACT

A connector including a contact element arranged in an interior of the connector and contacting an electrical connection element and an impedance improving element located at a side of the electrical connection element. The impedance improving element has a reception channel through which the contact element extends and a deformation section adapted to be deformed at least one of radially and axially.

14 Claims, 12 Drawing Sheets

(56) References Cited

U.S. PATENT DOCUMENTS

| | | | |
|---|---|---|---|
| 3,681,739 | A | 8/1972 | Kornick |
| 3,711,942 | A | 1/1973 | Reynolds |
| 3,797,104 | A | 3/1974 | Pote |
| 3,824,686 | A | 7/1974 | Forney, Jr. |
| 3,868,616 | A | 2/1975 | Yonkers |
| 4,426,127 | A | 1/1984 | Kubota |
| 4,707,566 | A | 11/1987 | Titcombe et al. |
| 4,789,351 | A | 12/1988 | Fisher, Jr. et al. |
| 5,083,943 | A | 1/1992 | Tarrant |
| 5,123,864 | A | 6/1992 | Karlovich |
| 5,217,391 | A | 6/1993 | Fisher, Jr. |
| 5,547,405 | A | 8/1996 | Pinney et al. |
| 6,149,448 | A | 11/2000 | Haller et al. |
| 6,210,191 | B1 | 4/2001 | Sai |
| 6,641,421 | B1 | 11/2003 | Leavitt et al. |
| 6,666,698 | B2 | 12/2003 | Beck, Jr. et al. |
| 6,869,320 | B2 | 3/2005 | Haas et al. |
| 7,351,101 | B1 | 4/2008 | Montena |
| 8,333,603 | B1 | 12/2012 | Daugherty et al. |
| 8,366,483 | B2 | 2/2013 | Hardy et al. |
| 8,574,007 | B2 | 11/2013 | Smith et al. |
| 8,662,924 | B2 | 3/2014 | Davis et al. |
| 8,727,807 | B2 | 5/2014 | Sykes et al. |
| 9,147,963 | B2 | 9/2015 | Balcer et al. |
| 9,159,472 | B2 | 10/2015 | Nordin et al. |
| 9,350,063 | B2 | 5/2016 | Herbsommer et al. |
| 9,350,125 | B2 | 5/2016 | Jones et al. |
| 9,537,231 | B2 | 1/2017 | Hall et al. |
| 9,590,339 | B2 | 3/2017 | Oberski et al. |
| 9,705,240 | B2 | 7/2017 | Benham et al. |
| RE46,958 | E | 7/2018 | Vinther et al. |
| 2006/0030208 | A1 | 2/2006 | Cassanego et al. |
| 2010/0297867 | A1 | 11/2010 | Rosenberger |
| 2012/0270442 | A1 | 10/2012 | Holliday |
| 2014/0106614 | A1 | 4/2014 | Burris et al. |

FOREIGN PATENT DOCUMENTS

| | | | |
|---|---|---|---|
| EP | 1081803 | A1 | 3/2001 |
| EP | 3179562 | A1 | 6/2017 |
| EP | 3179563 | A1 | 6/2017 |
| EP | 3179565 | A1 | 6/2017 |
| EP | 3220483 | A1 | 9/2017 |
| JP | 2010182631 | A | 8/2010 |
| JP | 2011124136 | A | 6/2011 |
| JP | 201929103 | A | 2/2019 |

OTHER PUBLICATIONS

Extended European Search Report, Application No. 19169265.6, dated Oct. 9, 2019, 8 pages.

Abstract of JP2010182631, dated Aug. 19, 2010, 1 page.

Coaxial Size 1 Contacts for ARINC 404 and 600 Applications, dated May 23, 1990, 9 pages.

Fan Yang, et al., A New Method For Determining The Connection Resistance of the Compression Connector in Cable Joint, published Jun. 26, 2018, 42 pages.

Abstract of JP2011124136, dated Jun. 23, 2011, 1 page.

Machine translation of JP2019029103A, dated Feb. 21, 2019, 41 pages.

Mohd Ruzlin M. M., et al., "Study of Cable Crimping Factors Affecting Contact Resistance of Medium Voltage Cable Ferrule and Lug", dated Jun. 2013, 4 pages.

CONNECTOR FOR HIGH-FREQUENCY TRANSMISSIONS IN THE AUTOMOTIVE FIELD, IMPEDANCE IMPROVING ELEMENT, CONNECTION ASSEMBLY, METHOD OF IMPROVING THE IMPEDANCE IN A CONNECTOR

CROSS-REFERENCE TO RELATED APPLICATION

This application claims the benefit of the filing date under 35 U.S.C. § 119(a)-(d) of European Patent Application No. 19169265.6, filed on Apr. 15, 2019.

FIELD OF THE INVENTION

The present invention relates to a connector and, more particularly, to a connector for high-frequency transmissions.

BACKGROUND

Connectors that are used in the automotive field are produced in large quantities. It has recently become desirable to transmit data with a high rate and thus at high frequencies. However, current connectors suitable for high-frequency transmissions are difficult to produce and expensive and thus unsuitable in the automotive field.

SUMMARY

A connector including a contact element arranged in an interior of the connector and contacting an electrical connection element and an impedance improving element located at a side of the electrical connection element. The impedance improving element has a reception channel through which the contact element extends and a deformation section adapted to be deformed at least one of radially and axially.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
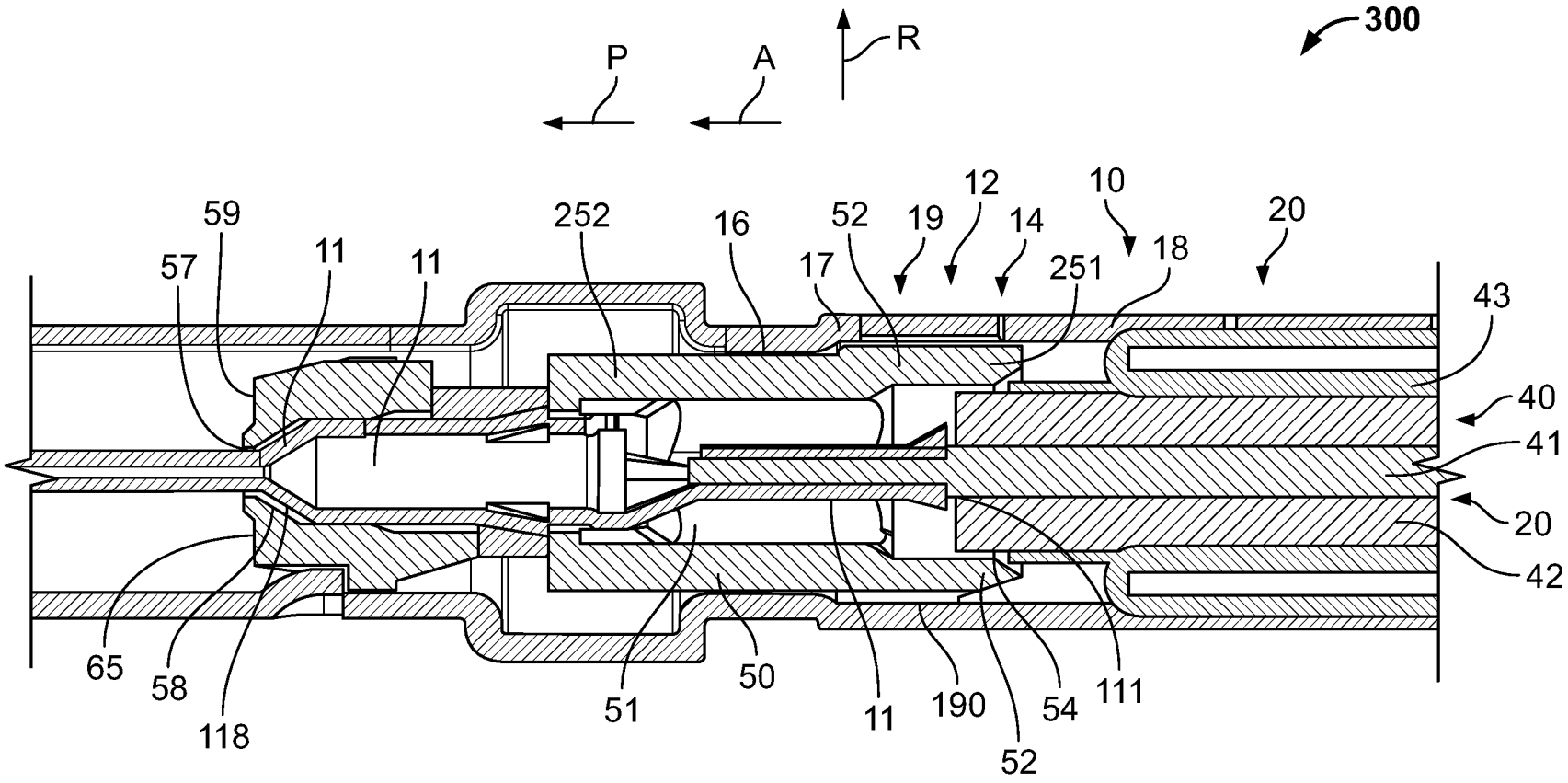
FIG. 1 is a longitudinal sectional view of a connector according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the invention to those skilled in the art. The described embodiments are only possible configurations in which, however, the individual features as described above can be provided independently of one another or can be omitted.

A connector 10 according to an embodiment and a method for improving an impedance in the connector 10 is shown in FIGS. 1-5. The connector 10 can be used in the automotive field. However, other applications are of course also possible. The connector 10 is adapted to be connected to a mating connector 30 (see for example FIG. 2) by plugging the connector 10 along a plugging direction P into the mating connector 30.

Figure 2:
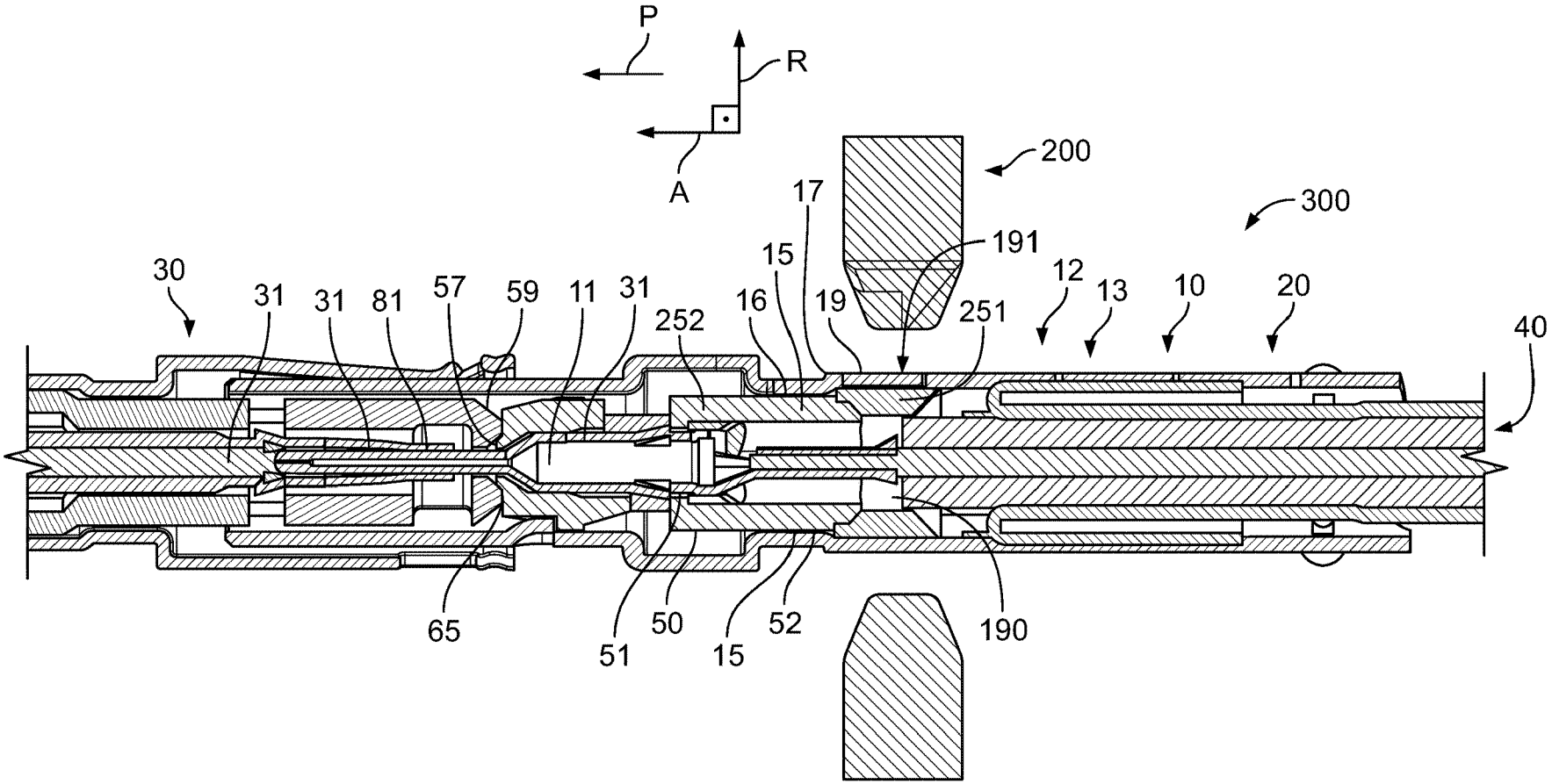
FIG. 2 is a longitudinal sectional view of the connector of FIG. 1 and a mating connector.
Figure 3:
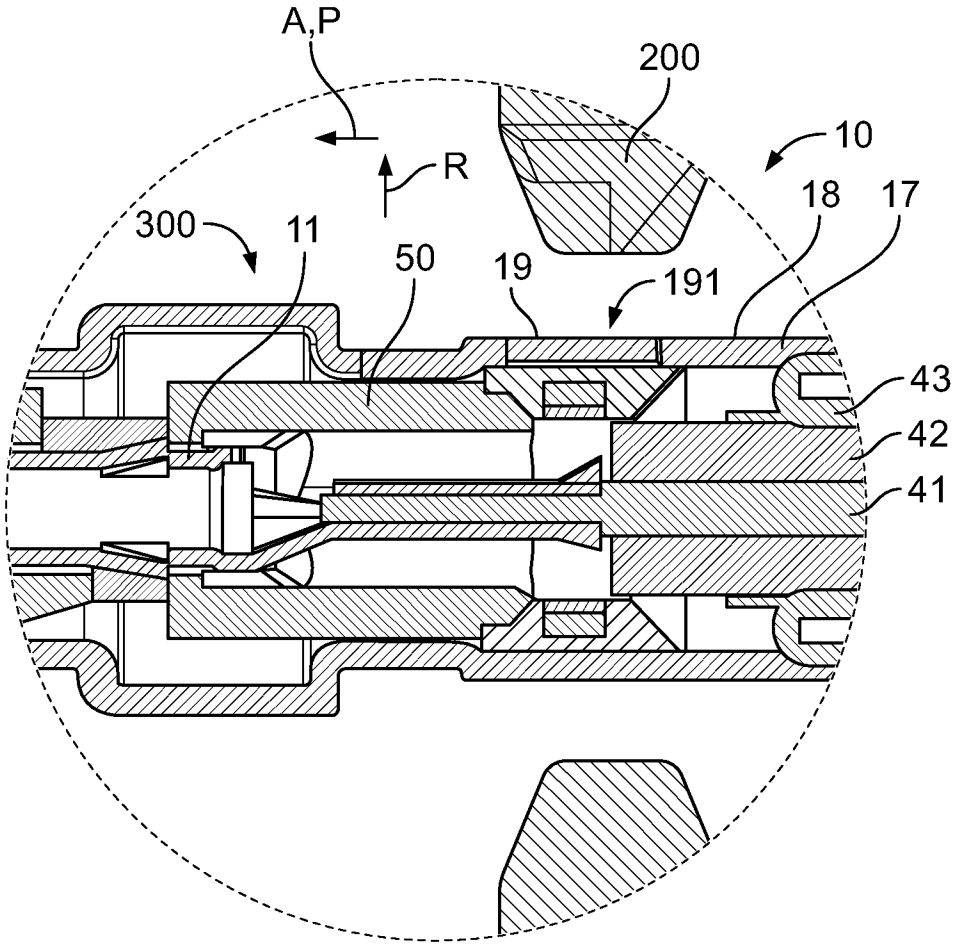
FIG. 3 is a detail view of a portion of FIG. 2.

The connector 10, as shown in FIGS. 1 and 2, has a contact element 11, which in this example is embodied as a pin that can be received in a mating contact element 31 of the mating connector 30, for example in a socket. The contact element 11 is arranged in an interior 15 of the connector 10 and is adapted to make contact to an electrical connection element 20 like the mating connector 30 at a distal end 13 or a cable 40 at a proximal end 14 opposite the distal end 13. The electrical connection element 20 has a side 12. A connection assembly 300 comprises the connector 10 and the cable 40 attached to the connector 10.

In the embodiment shown in FIGS. 1 and 2, the contact element 11 is attached to a core conductor 41 of the cable 40. The core conductor 41 is surrounded by a dielectric insulation 42 which is in turn surrounded by an outer conductor 43 of the cable 40.

The conductor 10, as shown in FIGS. 1-5, includes an impedance improving element 50 located at the side 12 of the electrical connection element 20. In the shown embodiment, the impedance improving element 50 is located at a side of the cable 40 in order to improve the connection between the cable 40 and the contact element 11. The impedance improving element 50 includes a reception channel 51 for the contact element 11 in the connector 10, through which the contact element 11 extends. The impedance improving element 50 includes a deformation section 52 that is adapted to be deformed. In the shown embodiment, the deformation section 52 is adapted to be deformed in a radial direction R that is perpendicular to the axial direction A along which the contact element 11 extends. The axial direction A is parallel to the plugging direction P.

The impedance improving element 50 is made from a dielectric material so that it provides an insulating effect. The impedance improving element 50 can, for example, be made from a plastic material or a rubber-like material. The deformation section 52 can comprise a foam material in order to be easily deformable. The foam material can be open or closed cell foam. In other embodiments, the deformation section can comprise a heat-shrinkable material. The deformation section 52 can be elastically or plastically deformable. The impedance improving element 50 can comprise visco-elastic materials such as dry silicone gel. These materials can be squeezed into non-functional voids which has the additional advantage of a constant permittivity.

The impedance improving element 50, as shown in FIG. 1, is located at a proximal side 14 of the connector 10. The impedance improving element 50 includes a receptacle 54 for the dielectric insulation 42 of the cable 40. The dielectric insulation 42 thus protrudes into the interior 15 of the impedance improving element 50.

The connector 10, as shown in FIGS. 1-5, includes a crimping section 19 that is adapted to be crimped radially; the crimping section 19 can be a deformable metal. The crimping section 19 is plastically deformable in the radial direction R. As shown in FIGS. 2-5, a crimping tool 200 is used to deform the crimping section 19 and the deformation section 52 of the impedance improving element 50 by applying a radial pressure. In this crimping step, the crimping section 19 squeezes the impedance improving element 50 onto the cable 40 and thus also mechanically connects the two. The crimping process leaves an indent 191 in a housing 17 of the connector 10.

The housing 17 also has a shielding 18 that is connected to the outer conductor 43 of the cable and provides an electromagnetic shielding. The shielding 18 can be a part of the housing 17. In particular, the shielding 18 can make up the entire housing of the connector 10. In FIG. 2, a cross-section is shown in which an indent 191 is located in the background.

The deformation section 52 is located in a space 190 defined by the crimping section 19, as shown in FIGS. 1 and 2. After the crimping and the deformation, the interior of the impedance improving element 50 is sealed. The core conductor 41 of the cable is thus insulated from the outer conductor 43 and short circuits through conduction through air or dirt are minimized.

The impedance improving element 50 can be mounted either to the cable 40 or to the connector 10 before the crimping takes place. This allows an easy assembly. The impedance improving element 50 can, for example, be attached by glue or through an elastic fit. When viewed from a front side, the impedance improving element 50 covers an entire circumference of the contact element 11. This maximizes the impedance improving effect and guarantees sealing.

The impedance improving element 50 can be produced by a molding process. The impedance improving element 50 can be molded onto an existing element, for example the housing 17. Alternatively, the impedance improving element 50 can be a separate part that can be attached to a further part. The impedance improving element 50 can be configured to be attached to already existing connectors to improve their performance. In an alternative embodiment, the impedance improving element 50 can be produced by machining.

The amount to which the crimping tool 200 deforms the crimping section 19 and the deformation section 52 of the impedance improving element 50, shown in FIGS. 2-5, can be adjusted depending on the desired impedance in this area. It can, for example, be adjusted during the crimping process by measuring the impedance. The impedance can, for example, be measured during the deformation process by time-domain reflectometer ("TDR") measurements.

Figure 5:
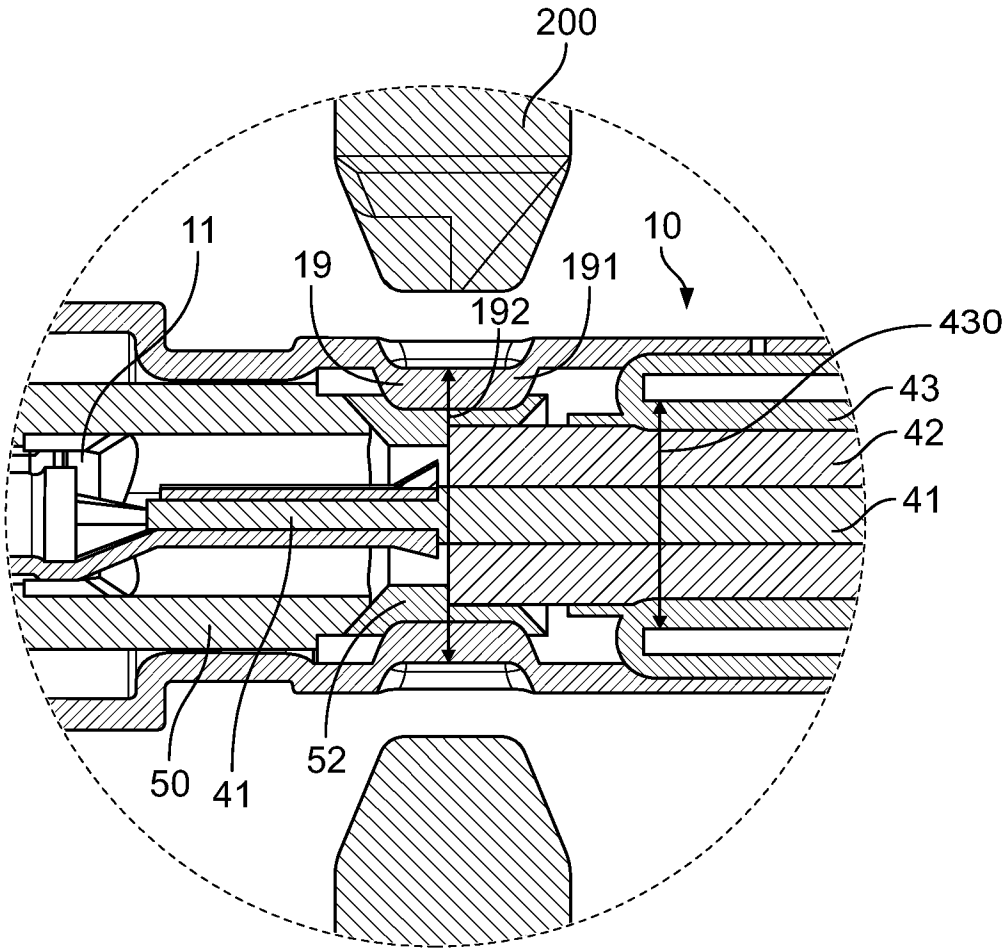
FIG. 5 is a detail view of a portion of FIG. 4.

The crimping tool 200 can perform a crimping around the entire circumference of the connector 10 or only in parts. The adjustment can, for example, be done by adjusting the crimp height. For example, as shown in FIG. 5, a cross section 192 and/or the circumference of the housing 17 and the shielding 18 at the crimp section 19 can correspond to a cross section 430 and/or circumference at the outer conductor 43 of the cable 40. A deviation of plus/minus 20% in these values can be considered as corresponding. The cross section 192 and/or the circumference at the crimp section 19 can be smaller than the cross section 430 and/or circumference at the outer conductor 430 of the cable 40. By this, nearby sections with bigger cross sections or circumferences can be compensated.

The impedance at the deformation section 19 can be adjusted to correspond to the impedance of the cable 40. A deviation of plus/minus 20% in the impedances can be considered as corresponding. The impedance at the deformation section 19 can be adjusted to be lower than the impedance of the cable. This can be used to compensate a higher impedance region before or after the crimping section 19.

The impedance improving element 50 can be tube-like or sleeve like. This can enable an easy assembly. It can have a circular cross-section. In other embodiments, it can have different cross-sections. For example, the impedance improving element 50 can at least in sections have a circular cross-section in order to improve the mounting process. Alternatively, it can have other types of cross-sections, for example a rectangular or an elliptic cross-section.

The impedance improving element 50, as shown in FIGS. 1 and 2, can have a first section 251 with a large inner diameter and a second section 252 with a smaller inner diameter.

The contact element 11 can protrude out of the impedance improving element 50 through a through-hole 57 at a distal end 13, as shown in FIGS. 1 and 2. Simple contacting can be achieved with this arrangement. The contact element 11 and the through-hole 57 can have mating inclined surfaces 58, 118 to allow a precise positioning.

The impedance improving element 50 can comprise a stop face 65, as shown in FIGS. 1 and 2, for corresponding elements of the mating connector 30. This can allow a precise positioning.

Figure 4:
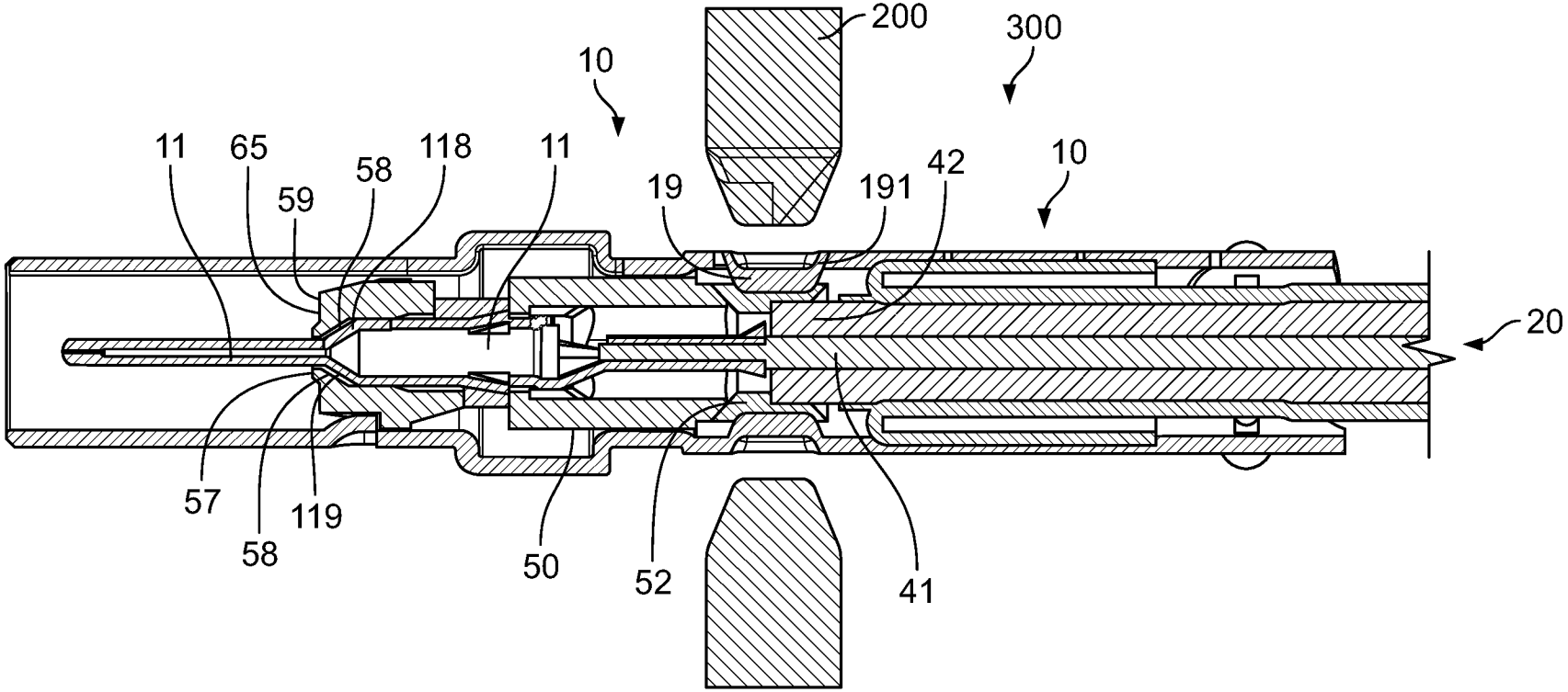
FIG. 4 is a longitudinal sectional view of the connector of FIG. 1 after a crimping step.

The impedance improving element 50, as shown in FIGS. 1, 2, and 4, can comprise a sealing surface 59 at the distal side 13 for sealing the contact element 11 together with corresponding elements at the mating connector 30.

Figure 6:
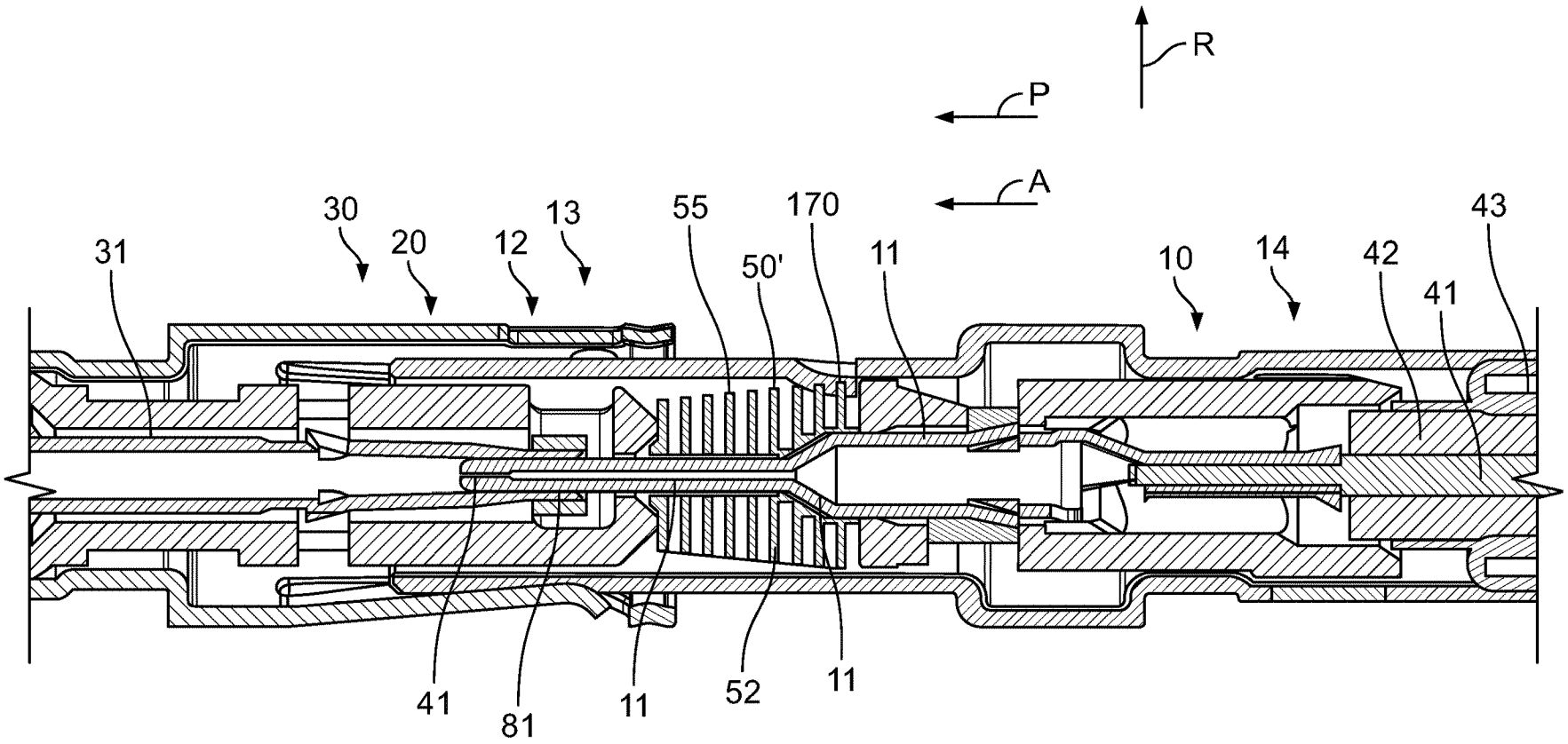
FIG. 6 is a longitudinal sectional view of a connector according to another embodiment.
Figure 7:
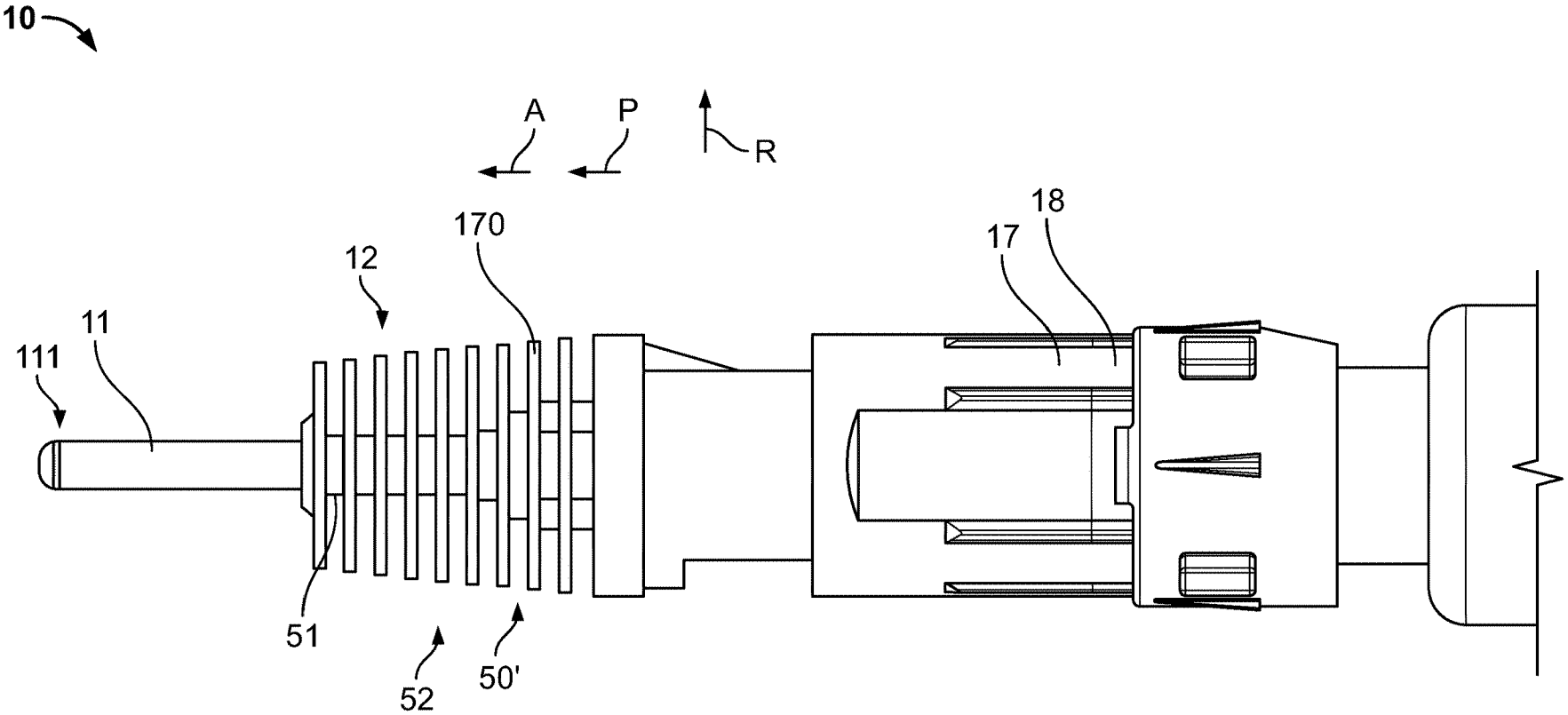
FIG. 7 is a longitudinal side view of a connector of FIG. 6.

A connector 10 according to another embodiment is shown in FIGS. 6 and 7 with an impedance improving element 50. Like references refer to like elements, and only the differences with respect to the embodiment shown in FIGS. 1-5 will be described in detail herein.

In FIG. 6, the connector 10 is connected to the mating connector 30, which comprises a socket as a mating contact element 31 for the contact element 11 of the connector 10. The connector 10 is again used in the automotive field. In this field, large quantities of connectors 10 need to be manufactured at low cost. The manufactured connectors 10 then have big tolerances and the distance between the connector 10 and the counter connector 30 varies considerably. This leads to variations in the impedance of the connection assembly 300.

Apart from the already described impedance improving element 50 located in the transition area between the contact element 11 and the cable 40, the connector 10 according to the embodiment of FIGS. 6 and 7 includes a second impedance improving element 50' located around a front part of the contact element 11. The impedance improving element 50' again includes a reception channel 51 for the contact element 11. The impedance improving element 50' also includes a deformation section 52 adapted to be deformed. The deformation section 52 of this impedance improving element 50' has a spring section 55 that can be deformed axially. When making contact to the mating connector 30, the deformation section 52 is deformed along the axial direction A of the contact element 11. By this, the space between the contact element 11 and a housing 17 of the connector 10 is filled with dielectric material and the impedance is improved. The embodiment shown in FIGS. 6 and 7 includes a plurality of discs 170, the planes of which run along the radial direction R and are thus perpendicular to the plugging direction P and the axial direction A. The disks 170 can thus provide an insulating effect.

Figure 8:
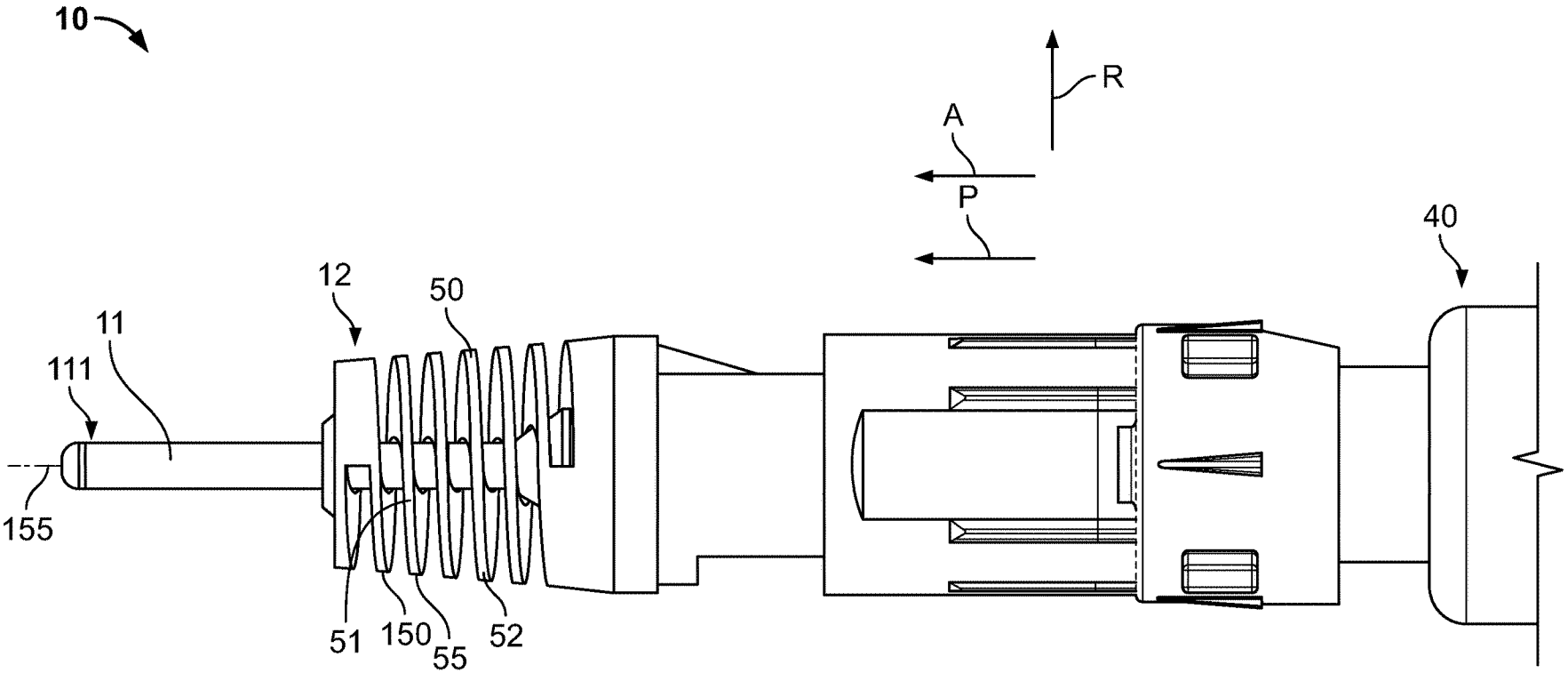
FIG. 8 is a longitudinal side view of a connector according to another embodiment.

A connector 10 according to another embodiment is shown in FIG. 8. Like references refer to like elements and only the differences with respect to the above embodiments will be described in detail herein. The connector 10 in the embodiment of FIG. 8 includes the impedance improving element 50 located around the contact element 11. The impedance improving element 50 comprises a deformation section 52 that can be deformed axially. The deformation section 52 comprises a helicoid section 150 in which material is arranged in a screw-like manner. The axis 155 of the helicoid section 150 runs along the plugging direction P of the connector 10. Such a configuration can result in spring forces in a spring section 55 along the axial direction A. The spring constant can be, for example, adjusted by an appropriate choice of material thickness and winding density of the helicoid section 150. When the connector 10 is plugged into the mating connector 30, the deformation section 52 is automatically deformed. Thereby, the impedance is improved independent of the production tolerances.

Figure 9:
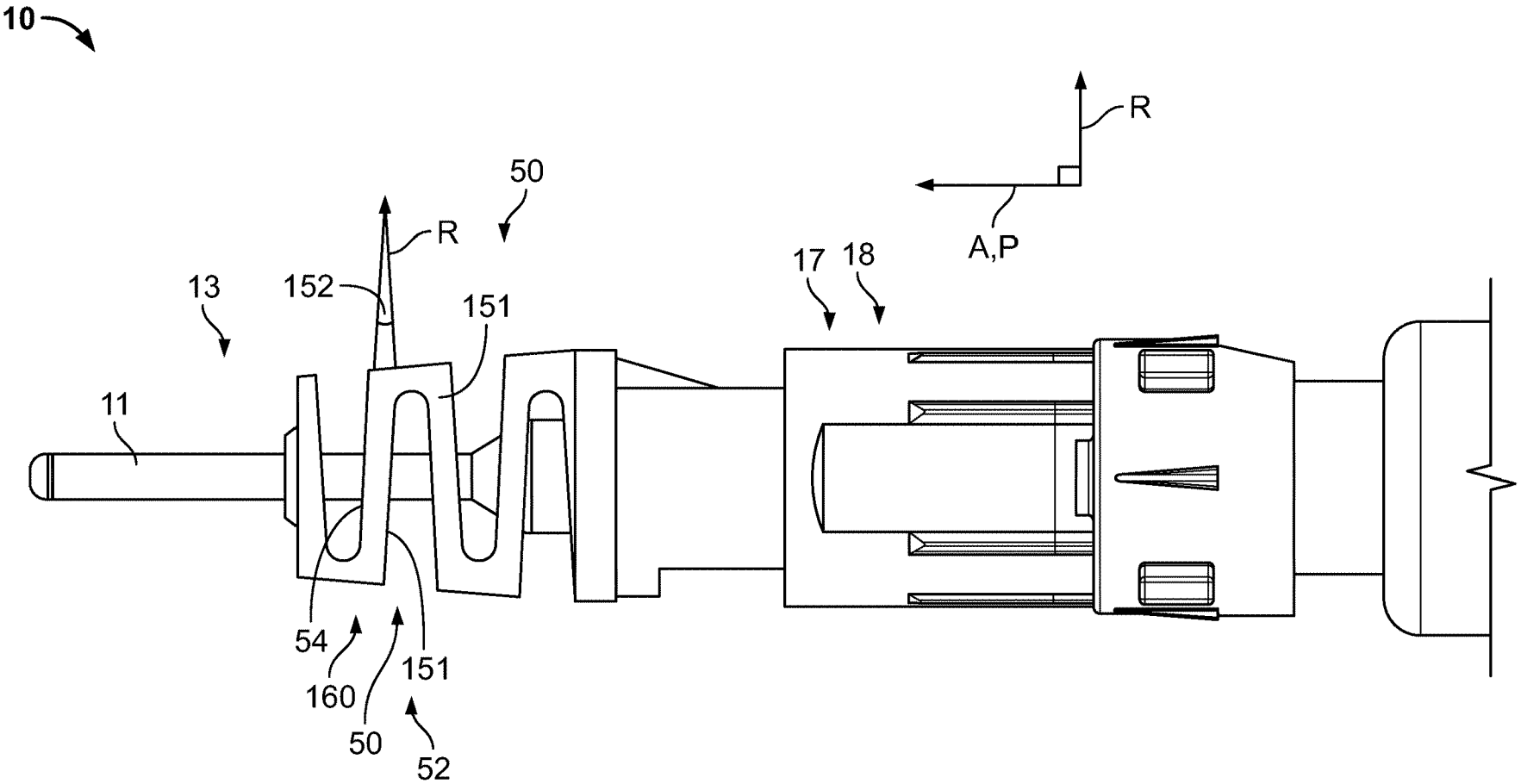
FIG. 9 is a longitudinal side view of a connector according to another embodiment.

A connector 10 according to another embodiment is shown in FIG. 9. Like references refer to like elements and only the differences with respect to the above embodiments will be described in detail herein. In the embodiment shown in FIG. 9, a deformation section 52 of the impedance improving element 50 comprises a zigzag section 160 with inter-connected sections 151. Each of the interconnected sections 51 has a slight angle 152 relative to the radial direction R.

In the embodiments of FIGS. 6-9, the impedance improving element 50 is located between an attachment section 16, at which the contact element 11 is attached to the housing 17 of the connector 10, and an end 111 of the contact element 11, the end 111 being configured to be connected to the electrical connection element 20 in the form of the mating connector 30.

Further, in the embodiments of FIGS. 6-9, the impedance element 50 is located at the distal side 13 of the connector 10, the distal side 13 being configured to be connected to the mating connector 30.

The impedance improving element 50 is located next to a contact area 81, shown by comparison to FIG. 2, in which the contact element 11 contacts the mating contact element 31. Moreover, the impedance improving element 50 covers at least across its length 360° of the circumference of the contact element 10.

Figure 10A:
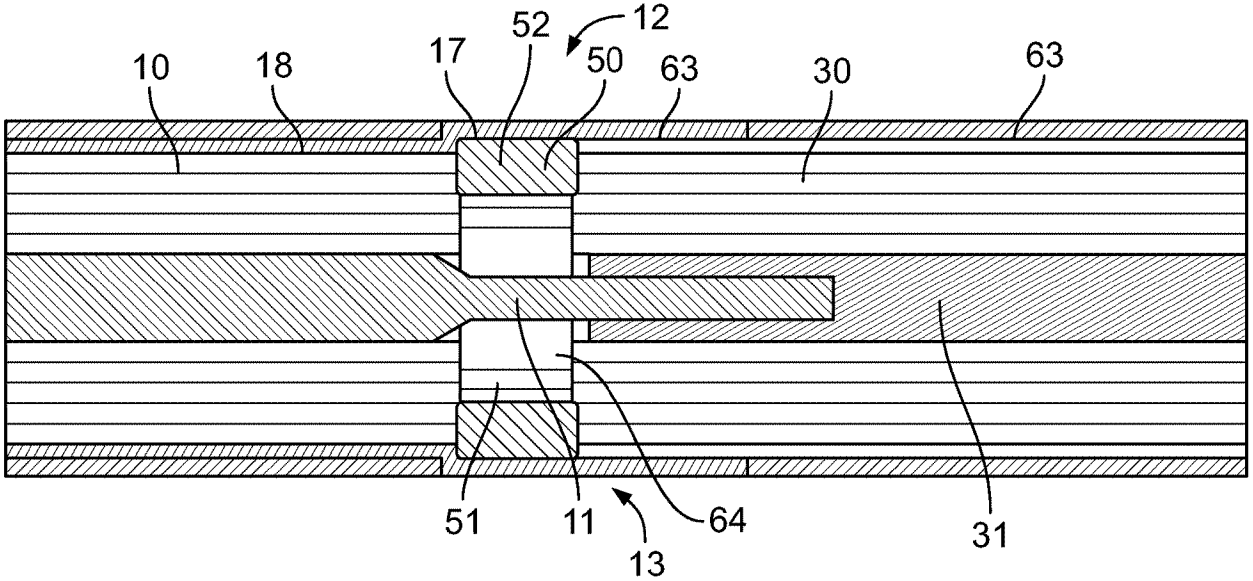
FIG. 10A is a longitudinal sectional view of a connector according to another embodiment and a mating connector at a first mating depth.
Figure 10B:
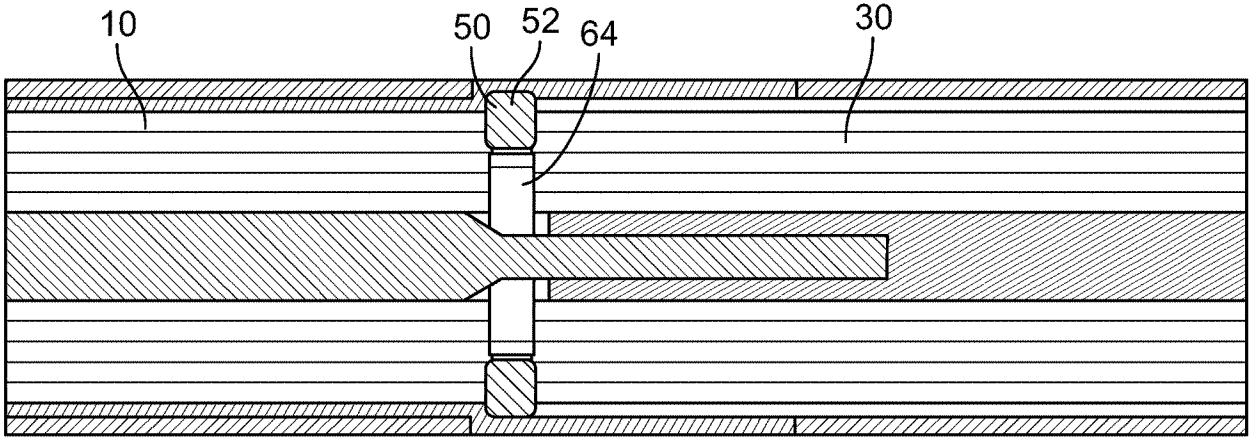
FIG. 10B is a longitudinal sectional view of the connector and the mating connector of FIG. 10A at a second mating depth.
Figure 11A:
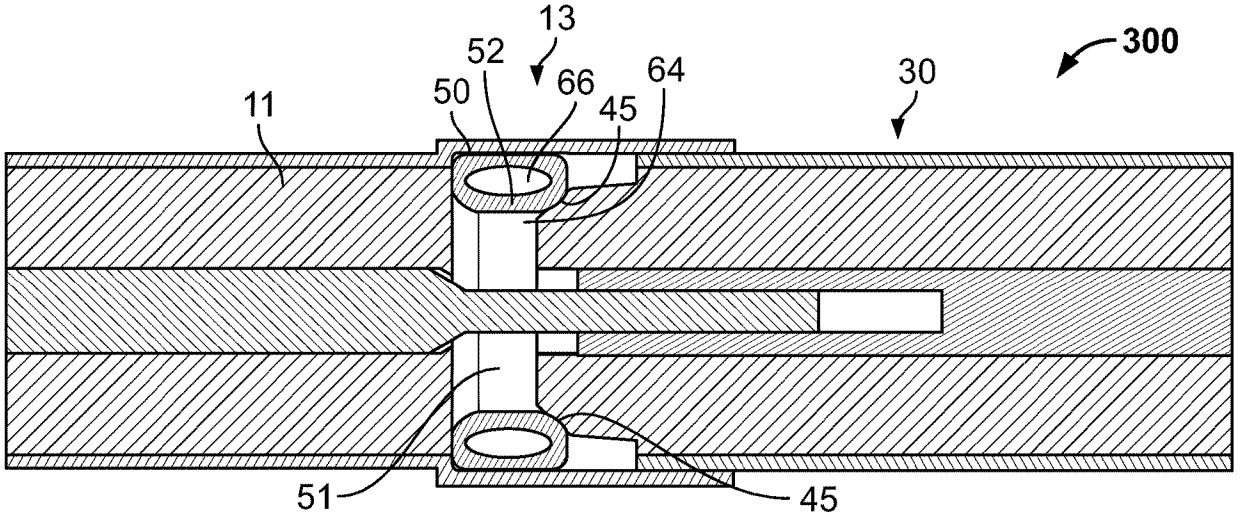
FIG. 11A is a longitudinal sectional view of a connector according to another embodiment and a mating connector at a first mating depth.
Figure 11B:
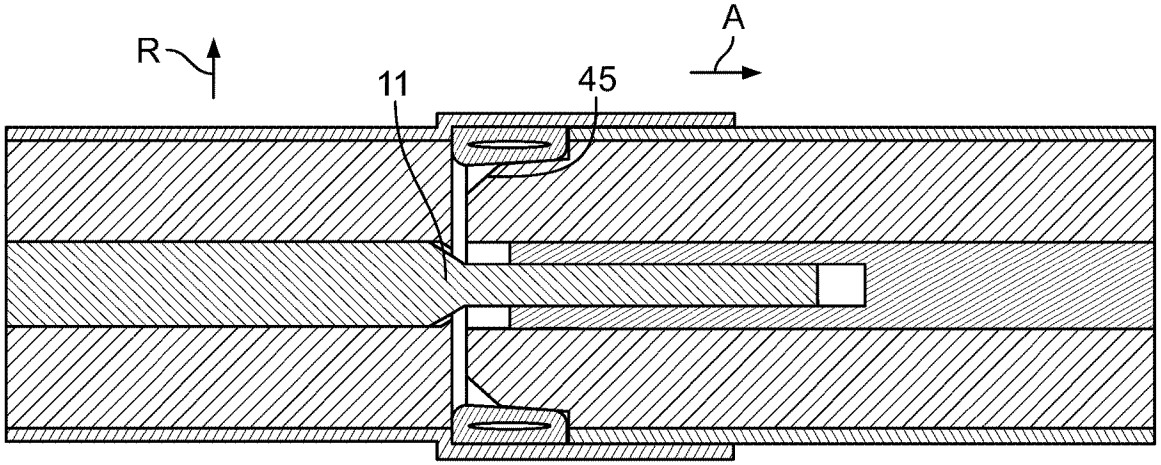
FIG. 11B is a longitudinal sectional view of the connector and the mating connector of FIG. 11A at a second mating depth.

In FIGS. 10A and 10B, a further embodiment of a connector 10 with an impedance improving element 50 is shown. The connector 10 is connected to a mating connector 30 and shown with different mating depths in FIGS. 10A and 10B. The impedance improving element 50 is a conductive material and is in a conductive electric connection with an outer conductor 63 of the connector 10. The conductive material can, for example, be a metal or a material comprising metal, for in-stance a hybrid material comprising a dielectric material and a conductive network within the dielectric material. The outer conductor 63 is in this case a housing 17 which also serves as a shielding 18 and is connected to ground. This outer conductor 63 is also connected to an outer conductor 63 of the mating connector 30. The deformability of the impedance improving element 50 results in an improved impedance for all mating depths. The impedance improving element 50 is embodied as a ring that surrounds an empty space 64 which serves as the reception channel 51 for the contact element 11.

FIGS. 11A, 11B, 12A and 12B show further embodiments of a connector 10. In these embodiments, the impedance improving element 50 and the deformation section 52 are radially deformable. As in the embodiment of FIGS. 10A and 10B, the impedance improving element 50 is configured to contact an outer conductor 63 and comprises an electrically conductive material. The impedance improving element 50 is again located at a distal side 13 of the connector 10, the distal side 13 being the side that is adapted to contact the mating connector 30. The impedance improving element 50 has a basically torus-shaped configuration in which an outer ring has a hollow section 66 at the inside. Due to the hollow section 66, the deformability of the deformation section 52 is improved. A wedge-shaped front section 45 of the mating connector 30 deforms the impedance improving element 50 when it is connected to the counter connector. During this insertion process, the impedance improving element 50, in particular the deformation section 52 is deformed radially and the hollow section 66 is squeezed to a minimal volume. Due to the fact that the deformation section 52 is deformed radially, the impedance of the impedance improvement element 50 differs depending on the mating or insertion depth of the mating connector 13, improving the overall impedance of the connection assembly 300.

Figure 12A:
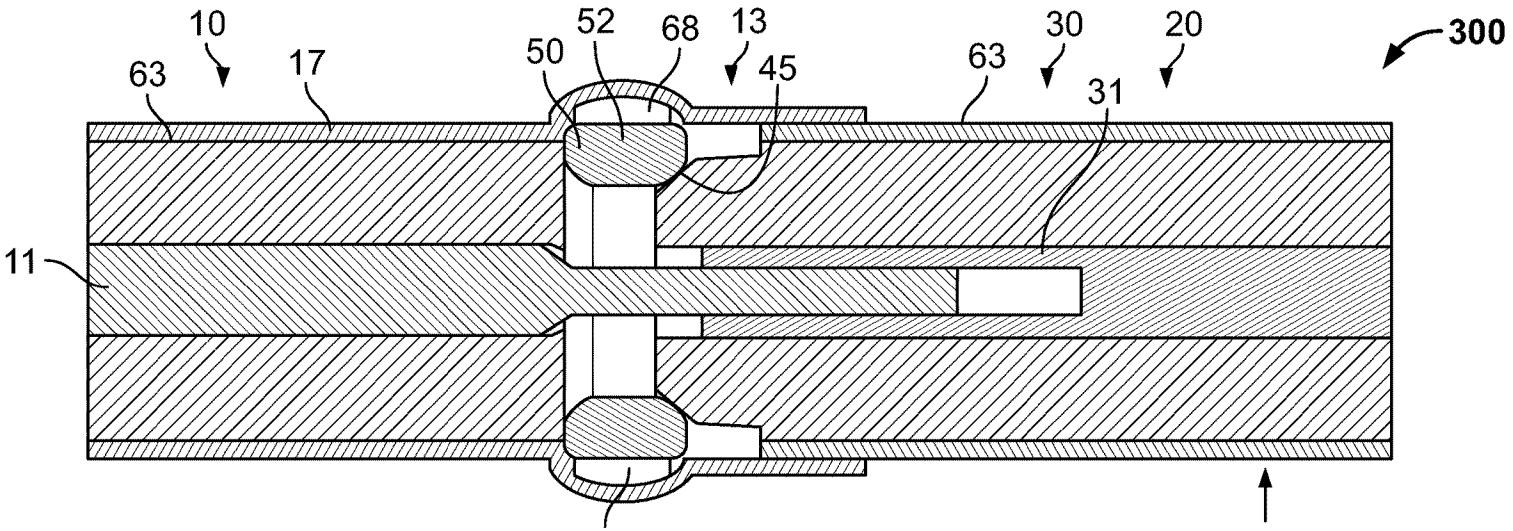
FIG. 12A is a longitudinal sectional view of a connector according to another embodiment and a mating connector at a first mating depth.
Figure 12B:
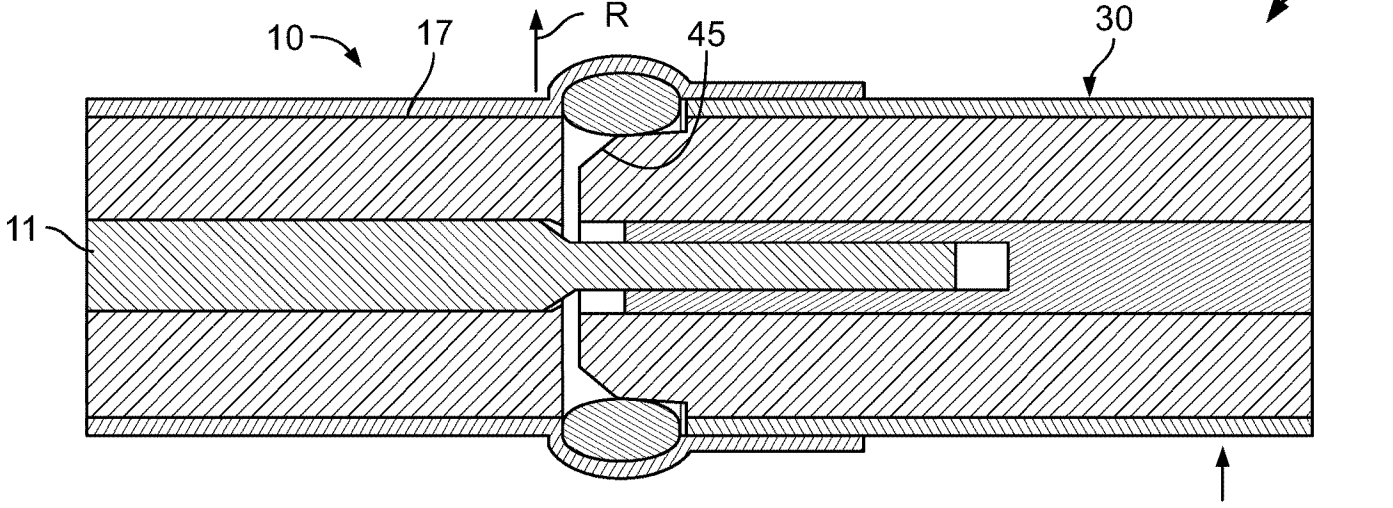
FIG. 12B is a longitudinal sectional view of the connector and the mating connector of FIG. 12A at a second mating depth.

In FIGS. 12A and 12B, a further embodiment is shown. The impedance improving element 50 is again located at a distal side 13 of the connector 10 and radially deformable. When the mating connector 30 is inserted into a connector 10, the deformation section 52 of the impedance improving element 50 is deflected radially outwards due to a wedge-shaped front section 45 on the mating connector 30. To take up the impedance improving element 50, a recess 68 is present in the connector 10. The recess 68 is formed by an outer conductor 63 of the connector 10. The recess 68 is channel-like with the channel being open radially inwards in order to take up the radially outwardly deflecting impedance improving element 50. The impedance improving element 50 can again be electrically conductive and in electric contact with the outer conductor 63 of the connector 10. Depending on the insertion depth of the mating connector 13, the deflection of the impedance improving element 50, in particular the deformation section 52 varies. Accordingly, the appearance in this area also varies and the overall impedance of the connection assembly 300 is improved relative to a configuration without an impedance improving element 50.

In the depicted embodiments, the impedance improving elements 50 are separate parts that can be manufactured separately. In other embodiments, however, the impedance improving elements 50 could be integrated into or be monolithic with other parts. For example, a housing 17 or a dielectric insulation between a core conductor and an outer conductor could form an impedance improving element 50.

What is claimed is:

1. A connector, comprising:

a contact element arranged in an interior of the connector and contacting an electrical connection element, the electrical connection element is a cable or a mating connector; and an impedance improving element located at a side of the electrical connection element, the impedance improving element has a reception channel through which the contact element extends and a deformation section adapted to be deformed at least one of radially and axially, the impedance improving element has a receptacle receiving a dielectric insulation of the cable, the deformation section is deformed radially around the dielectric insulation.

2. The connector of claim 1, wherein the impedance improving element is located at a proximal end of the connector connected to the cable.

3. The connector of claim 1, further comprising a crimping section, the impedance improving element is located at the crimping section.

4. The connector of claim 1, further comprising a shielding, the impedance improving element is mounted to the shielding.

5. The connector of claim 1, wherein the impedance improving element is located at a distal end of the connector connected to the mating connector.

6. The connector of claim 5, wherein the deformation section is axially deformed by the mating connector.

7. The connector of claim 5, wherein the deformation section is radially deformed by the mating connector.

8. The connector of claim 1, wherein the impedance improving element is located between an attachment section at which the contact element is attached to a housing of the connector and an end of the contact element connected to the electrical connection element.

9. The connector of claim 1, wherein the deformation section is a foam material.

10. An impedance improving element for use in a connector, comprising:

a reception channel through which a contact element extends; and a deformation section adapted to be deformed at least one of radially and axially, the impedance improving element has a receptacle receiving a dielectric insulation of a cable, the deformation section is deformed radially around the dielectric insulation.

11. A connection assembly, comprising:

a cable having a dielectric insulation; and a connector including a contact element arranged in an interior of the connector and contacting the cable and an impedance improving element located at a side of the cable, the impedance improving element has a reception channel through which the contact element extends and a deformation section adapted to be deformed at least one of radially and axially, the deformation section seals and/or holds the dielectric insulation of the cable.

12. The connection assembly of claim 11, wherein the impedance improving element is mounted to the dielectric insulation.

13. A method of improving an impedance in a connector, comprising:

providing an impedance improving element having a reception channel through which a contact element of the connector extends and a deformation section adapted to be deformed;

moving the deformation section over a dielectric insulation of a cable; and deforming the deformation section radially.

14. The method of claim 13, wherein a deformation of the deformation section is controlled depending on the impedance of the connector.

* * * * *